US008016953B2

(12) United States Patent
Yamasaki et al.

(10) Patent No.: US 8,016,953 B2
(45) Date of Patent: Sep. 13, 2011

(54) HIGH-STRENGTH STEEL MATERIAL WITH EXCELLENT HYDROGEN EMBRITTLEMENT RESISTANCE

(75) Inventors: Shingo Yamasaki, Kimitsu (JP); Daisuke Hirakami, Futtsu (JP); Toshimi Tarui, Futtsu (JP); Seiki Nishida, Kimitsu (JP)

(73) Assignee: Nippon Steel Corporation, Tokyo (JP)

( * ) Notice: Subject to any disclaimer, the term of this patent is extended or adjusted under 35 U.S.C. 154(b) by 679 days.

(21) Appl. No.: 10/546,330

(22) PCT Filed: Jan. 20, 2004

(86) PCT No.: PCT/JP2004/000414

§ 371 (c)(1),
(2), (4) Date: Aug. 17, 2005

(87) PCT Pub. No.: WO2004/074529

PCT Pub. Date: Sep. 2, 2004

(65) Prior Publication Data

US 2006/0144474 A1 Jul. 6, 2006

(30) Foreign Application Priority Data

Feb. 20, 2003 (JP) ..... 2003-042398

(51) Int. Cl.
*C22C 38/12* (2006.01)

(52) U.S. Cl. ..... 148/328; 148/337; 420/124

(58) Field of Classification Search ..... 148/320, 148/328, 337; 420/124
See application file for complete search history.

(56) References Cited

U.S. PATENT DOCUMENTS

| | | | | |
|---|---|---|---|---|
| 2,572,191 | A * | 10/1951 | Payson | 420/104 |
| 4,778,652 | A | 10/1988 | Fukizawa et al. | |
| 6,224,686 | B1 | 5/2001 | Aoki et al. | |
| 7,074,286 | B2 * | 7/2006 | Klueh et al. | 148/660 |
| 2003/0201036 | A1 | 10/2003 | Hashimura et al. | |

FOREIGN PATENT DOCUMENTS

| | | |
|---|---|---|
| EP | 0 630 983 A1 | 12/1994 |
| EP | 1361289 A1 | 11/2003 |
| JP | 61-060822 | 3/1986 |
| JP | 61-064815 | 4/1986 |
| JP | 03173745 | 7/1991 |
| JP | 03-243744 | 10/1991 |

(Continued)

OTHER PUBLICATIONS

English Abstract and English Machine Translation of Tarui et al. (JP 2002-194481) (Jul. 2002).*

(Continued)

*Primary Examiner* — Roy King
*Assistant Examiner* — Jessee R. Roe
(74) *Attorney, Agent, or Firm* — Kenyon & Kenyon LLP

(57) ABSTRACT

The invention provides a steel material with satisfactory hydrogen embrittlement resistance, and particularly it relates to high-strength steel with satisfactory hydrogen embrittlement resistance and a strength of 1200 MPa or greater, as well as a process for production thereof. At least one simple or compound deposit of oxides, carbides or nitrides as hydrogen trap sites which trap hydrogen with a specific trap energy is added to steel, where the mean sizes, number densities, and length-to-thickness ratios (aspect ratio) are in specific ranges. By applying the specific steel components and production process it is possible to obtain high-strength steel with excellent hydrogen embrittlement resistance.

1 Claim, 5 Drawing Sheets

FOREIGN PATENT DOCUMENTS

| | | | |
|---|---|---|---|
| JP | 06-158170 | | 6/1994 |
| JP | 07-188840 | * | 7/1995 |
| JP | 07-278735 | | 10/1995 |
| JP | 08-134584 | * | 5/1996 |
| JP | 8-193240 | | 7/1996 |
| JP | 10017985 | | 1/1998 |
| JP | 2001-049393 | * | 2/2001 |
| JP | 2001288531 | | 10/2001 |
| JP | 2001288539 | | 10/2001 |
| JP | 2002-97551 | | 4/2002 |
| JP | 2002-194481 | | 7/2002 |
| JP | 2002327233 | | 11/2002 |

OTHER PUBLICATIONS

English Abstract and English Machine Translation of Ueda et al. (JP 2001-049393) (Feb. 2001).*

English Abstract and English Machine Translation of Kubota et al. (JP 07-278735) (1995).*

English Abstract and English Machine Translation of Fukiisawa et al. (JP 06-158170) (1994).*

Japanese Office Action in Japanese application No. 2005-502666 dated Jan. 18, 2011.

Japanese Office Action in Japanese application No. 2005-502666 dated Dec. 1, 2009.

* cited by examiner

HIGH-STRENGTH STEEL MATERIAL WITH EXCELLENT HYDROGEN EMBRITTLEMENT RESISTANCE

FIELD OF THE INVENTION

The present invention relates to a steel material with excellent hydrogen embrittlement resistance, and particularly it relates to a steel material for high-strength members with excellent hydrogen embrittlement resistance, having a tensile strength of 1200 MPa or higher.

BACKGROUND ART

High-strength steel ubiquitously used in machines, automobiles, bridges, buildings and the like, is produced by, for example, using medium carbon steel such as SCr, SCM or the like specified according to JIS G4104 and JIS G4105, having a C content of 0.20-0.35 wt %, for quenching and tempering treatment. However, it is a well known fact that all grades of steel with tensile strengths exceeding 1300 MPa are at increased risk of hydrogen embrittlement (delayed fracture), and the current maximum strength for architectural steel now in use is 1150 MPa.

Knowledge exists in the prior art for enhancing the delayed fracture resistance of high-strength steel, and for example, Japanese Examined Patent Publication HEI No. 3-243744 proposes the effectiveness of refinement of prior austenite grains and application of a bainite structure. While a bainite structure is indeed effective to prevent delayed fracture, bainite transformation treatment results in increased production cost. Refinement of prior austenite grains is proposed in Japanese Unexamined Patent Publication SHO No. 64-4566 and Japanese Examined Patent Publication HEI No. 3-243745. In addition, Japanese Examined Patent Publication SHO No. 61-64815 proposes addition of Ca. However, testing of these proposed solutions by the present inventors has led to the conclusion that they produce no significant improvement in the delayed fracture properties. Japanese Unexamined Patent Publication HEI No. 10-17985 also discloses hydrogen traps consisting of small compounds, but experimentation by the present inventors has suggested that specific conditions exist on the structures, sizes and morphology of precipitates which exhibit hydrogen trapping functions, and effective hydrogen trapping cannot be achieved based on compound sizes and number densities alone.

Thus, production of high-strength steel with significantly improved delayed fracture properties has been limited in the prior art.

SUMMARY OF THE INVENTION

The present invention has been accomplished in light of these circumstances, and its object is to realize steel with satisfactory delayed fracture resistance, and especially high-strength steel with satisfactory delayed fracture resistance and a strength of 1200 MPa or higher, as well as to provide a process for production of the same.

The present inventors first analyzed in detail the delayed fracture behavior of steel of various strength levels, produced by quenching and tempering treatment. It is already well known that delayed fracture occurs due to diffusible hydrogen which is introduced into steel from the external environment and diffusing through the steel at room temperature. Diffusible hydrogen can be measured from the curve obtained from the (temperature-hydrogen evolution rate from steel) relationship obtained by heating steel at a rate of 100° C./hr, as a curve having a peak at a temperature of about 100° C. FIG. 1 shows an example of such measurement, for samples held for 15 minutes after hydrogen charge (□), for 24 hours after hydrogen charge (●) and for 48 hours after hydrogen charge (○) at room temperature.

The present inventors have discovered that if hydrogen introduced from the environment is trapped at some sites in the steel, it is possible to render the hydrogen innocuous and inhibit delayed fracture even in the environment from which much higher amount of hydrogen is introduced into the steel. The absorbed hydrogen concentration was determined based on the difference between the area integral values of the hydrogen evolution rate curves obtained by heating a 10 mmϕ steel material at 100° C./hr, before and after hydrogen charge. The presence of sites which trap hydrogen (hereinafter referred to as "hydrogen trap sites") can be determined from the peak temperature and peak height of the hydrogen evolution rate curve, the concentration of hydrogen trapped in a given hydrogen trap site (hereinafter referred to as "hydrogen trap concentration") can be determined from the area integral value of the peak, and the activation energy required for hydrogen to dissociate from the trap site (hereinafter referred to as "hydrogen trap energy") E can be determined from the formula given below describing the hydrogen evolution behavior from steel. Since the hydrogen trap energy E is a constant which depends on material, the variables in equation (1) are ϕ and T. Equation (2) represents the rearranged logarithm of equation (1). Thus, hydrogen analysis is carried out at different heating rates, the hydrogen evolution peak temperatures are measured, and the slope of the line representing the relationship between ln(ϕ/T2) and −1/T is calculated to determine E.

$$E\phi/RT2=A\exp(-E/RT) \qquad \text{Equation (1)}$$

(where ϕ is the heating rate, A is the reaction constant for hydrogen trap dissociation, R is the gas constant and T is the peak temperature (K) of the hydrogen evolution rate curve).

$$\ln(\phi/T2)=-(E/R)/T+\ln(AR/E) \qquad \text{Equation (2)}$$

The delayed fracture resistance was evaluated by determining the "absorbed hydrogen concentration" which does not result in delayed fracture. In this method, diffusible hydrogen is introduced into a notched round rod test piece at different levels by electrolytic hydrogen charge, hydrochloric acid soaking and a hydrogen annealing furnace, the test piece is then Cd-plated to prevent effusion of hydrogen into the air from the sample during the delayed fracture test, and then a static load (90% of the tensile strength TS) is applied in air and the absorbed hydrogen concentration at which delayed fracture no longer occurs is evaluated. The hydrogen concentration is defined as the "threshold absorbed hydrogen concentration". A higher threshold absorbed hydrogen concentration for steel is associated with a more satisfactory delayed fracture resistance, and the value is unique to the steel material, being dependent on the steel components and the production conditions such as heat treatment. The absorbed hydrogen concentration in a sample is the value obtained by calculating the difference between the area integral values of the hydrogen evolution rate curves obtained by heating the steel material at 100° C./hr, before and after hydrogen charge, and it includes the hydrogen concentration trapped in the hydrogen trap sites.

As a result of this testing, the present inventors found that by forming microstructure comprising at least one simple or compound precipitate of oxides, carbides or nitrides which can serve as hydrogen trap sites having a hydrogen trap energy of 25-50 kJ/mol and a hydrogen trap concentration of 0.5 ppm or higher by weight, it is possible to increase the threshold absorbed hydrogen concentration even in a high-strength range exceeding 1200 MPa, and thus drastically improve the delayed fracture resistance (see FIG. 2). In addition to acquiring this knowledge, the present inventors also established a technique allowing formation of microstructures comprising simple or compound deposits of oxides, carbides and nitrides of types and forms which can serve as such hydrogen trap sites.

Based on the results of this investigation, it was concluded that a high-strength bolt with an excellent delayed fracture resistance can be realized by optimal selection of the steel material composition and the microstructure, and the present invention having the following gist was accomplished.

(1) A steel material with excellent hydrogen embrittlement resistance, characterized in that after being dipped in 1000 cc of a 20 wt % aqueous $NH_4SCN$ solution at 50° C. and subsequently held for 100 hours in air at 25° C., the remaining hydrogen concentration is 0.5 ppm or higher by weight with an activation energy of 25-50 kJ/mol.

(2) A steel material with excellent hydrogen embrittlement resistance, characterized in that after being dipped in 1000 cc of a 20 wt % aqueous $NH_4SCN$ solution at 50° C. and subsequently for 100 hours in air at 25° C., hydrogen analysis held raising the temperature at a rate of 100° C./hr yields a hydrogen evolution peak in a temperature range of 180° C. to 400° C. and the evolved hydrogen concentration is 0.5 ppm or greater by weight.

(3) A steel material with excellent hydrogen embrittlement resistance according to (1) or (2), characterized by comprising at least 0.1 vol % of a carbide, oxide, nitride or a composite compound thereof in a sheet form with a length of no greater than 50 nm and a length to thickness ratio (aspect ratio) of 3-20 and having an FCC (face-centered cubic) structure, the compound comprising at least 30 atomic percent V and at least 10 atomic percent Mo as constituent metal components.

(4) A steel material with excellent hydrogen embrittlement resistance according to (1) or (2), characterized by comprising at least 0.1 vol % of a carbide, oxide, nitride or a composite compound thereof in a sheet form with a length of no greater than 50 nm and a length to thickness ratio (aspect ratio) of 3-20 and having an FCC (face-centered cubic) structure, the compound comprising at least 30 atomic percent V and at least 8 atomic percent W as constituent metal components.

(5) A steel material with excellent hydrogen embrittlement resistance according to (3), characterized by comprising at a number density of at least $1\times10^{20}/m^3$ a carbide, oxide, nitride or a composite compound thereof in a sheet form with a length of no greater than 50 nm and a length to thickness ratio (aspect ratio) of 3-20 and having an FCC (face-centered cubic) structure, the compound comprising at least 30 atomic percent V and at least 10 atomic percent Mo as constituent metal components.

(6) A steel material with excellent hydrogen embrittlement resistance according to (4), characterized by comprising at a number density of at least $5\times10^{19}/m^3$ a carbide, oxide, nitride or a composite compound thereof in a sheet form with a length of no greater than 50 nm and a length to thickness ratio (aspect ratio) of 3-20 and having an FCC (face-centered cubic) structure, the compound comprising at least 30 atomic percent V and at least 8 atomic percent W as constituent metal components.

(7) A steel material with excellent hydrogen embrittlement resistance according to any one of (1)-(3) or (5), characterized in that the steel material comprises, by weight, C: 0.10-1.00%
Si: 0.05-2.0%
Mn: 0.2-2.0%
Mo: 0.05-3.0%
V: 0.1-1.5%, and the inequality $0.5<Mo/V<5$ is satisfied.

(8) A high-strength steel material with excellent hydrogen embrittlement resistance according to any one of (1), (2), (4), or (6), characterized in that the steel material comprises, by weight, C: 0.10-1.00%
Si: 0.05-2.0%
Mn: 0.2-2.0%
W: 0.05-3.5%
V: 0.1-1.5%, and the inequality $0.3<W/V<7.0$ is satisfied.

(9) A steel material with excellent hydrogen embrittlement resistance according to (7), characterized in that the steel material further comprises, by weight, one or more from among:

Cr: 0.05-3.0%
Ni: 0.05-3.0%
Cu: 0.05-2.0%.

(10) A high-strength steel material with excellent hydrogen embrittlement resistance according to (8), characterized in that the steel material further comprises, by weight, one or more from among:

Mo: 0.05-3.0%
Cr: 0.05-3.0%
Ni: 0.05-3.0%
Cu: 0.05-2.0%.

(11) A steel material with excellent hydrogen embrittlement resistance according to any one of (7) to (10), characterized in that the steel material further comprises, by weight, one or more from among:

Al: 0.005-0.1%
Ti: 0.005-0.3%
Nb: 0.005-0.3%
B: 0.0003-0.05%
N: 0.001-0.05%.

DETAILED EMBODIMENT CARRYING OUT THE INVENTION

Hydrogen Trap Sites

The following explanation concerns the reason for the limit on the hydrogen trap sites, as the most important aspect for improvement of the delayed fracture resistance of high-strength steel which is the object of the invention. Diffusible hydrogen which causes delayed fracture is generated by corrosion or electrolytic plating, and it is absorbed steel materials at room temperature. Assuming hydrogen absorption by corrosion, the delayed fracture resistance can be improved by controlling the chemical composition and microstructure to permit occlusion of at least 0.5 ppm by weight and preferably at least 1.0 ppm by weight of hydrogen with a trap energy of 25-50 kJ/mol and preferably 30-50 kJ/mol, after dipping in 1000 cc of a 20 wt % aqueous $NH_4SCN$ solution at 50° C. and subsequent holding for 100 hours in air at 25° C. When the steel is heated at a rate of 100° C./hr, hydrogen with a trap energy of 25-50 kJ/mol has a evolution peak in a temperature range of 180-600° C., while hydrogen with a trap energy of 30-50 kJ/mol has a evolution peak in a temperature range of 200-600° C.

(Compositional Form)

Figure 1:
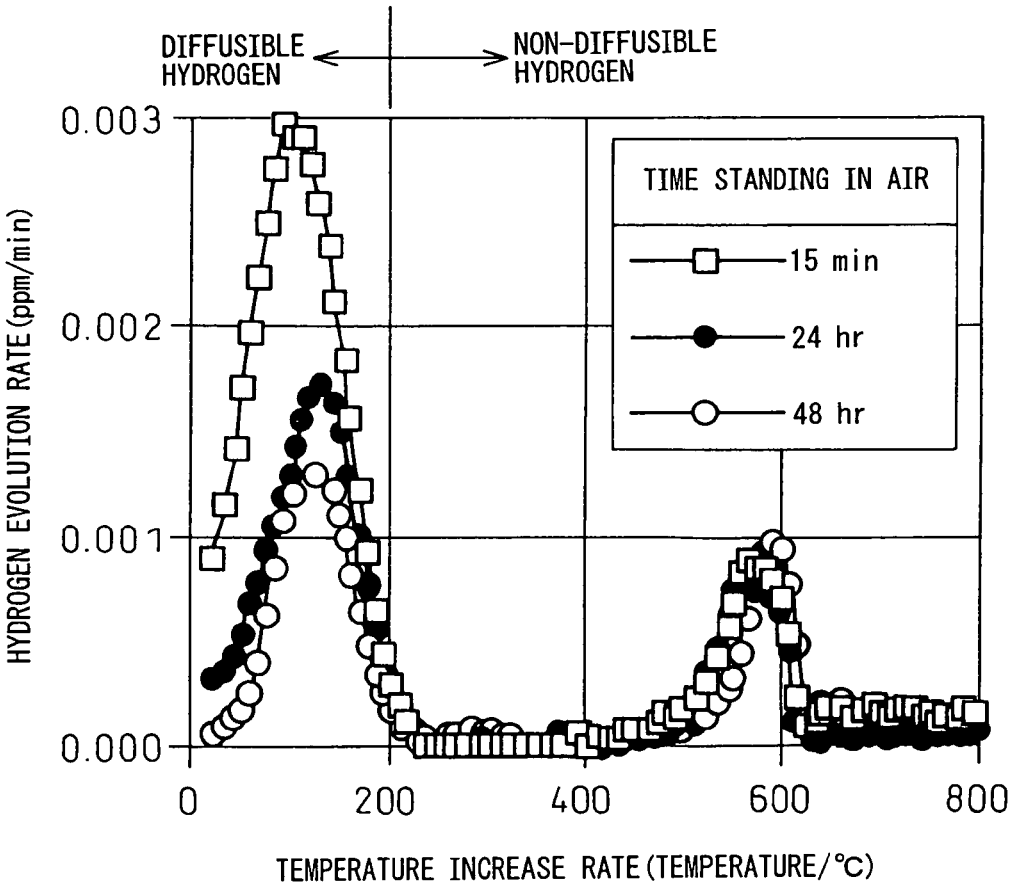
FIG. 1 is a graph showing hydrogen evolution rate curves during heating.
Figure 2:
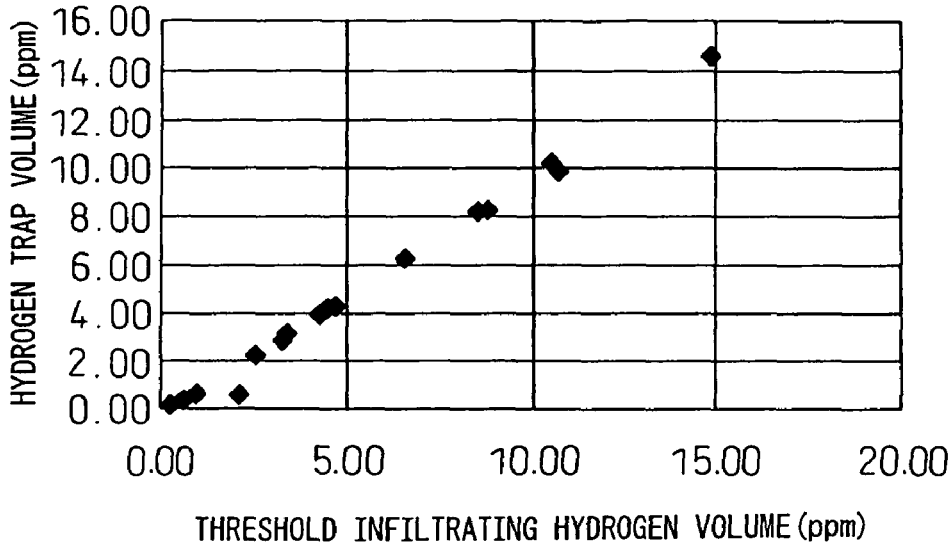
FIG. 2 is a graph showing the relationship between threshold absorbed hydrogen concentration and hydrogen trap concentration.
Figure 3:
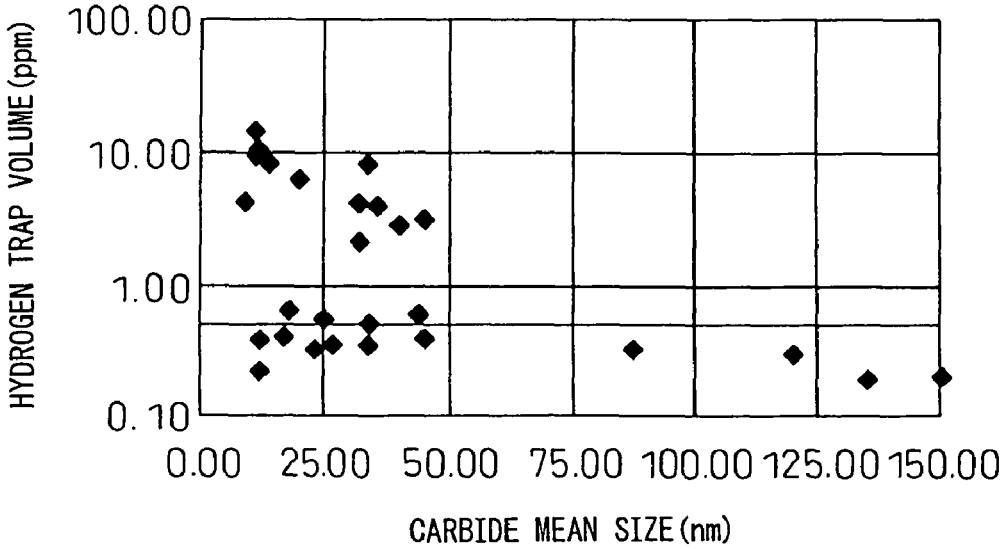
FIG. 3 is a graph showing the relationship between carbide mean size and hydrogen trap concentration.
Figure 4:
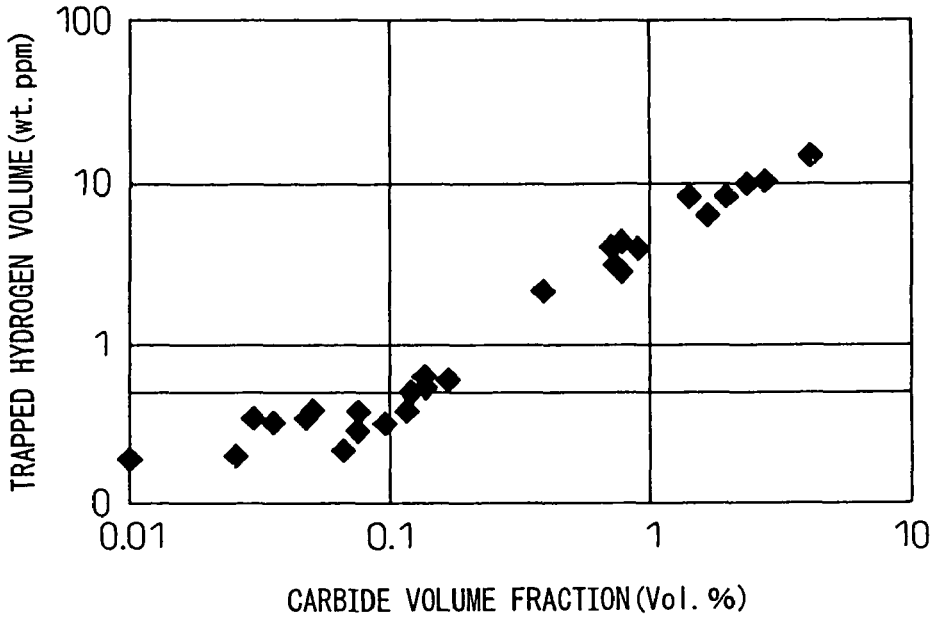
FIG. 4 is a graph showing the relationship between volume ratio and hydrogen trap concentration for carbides satisfying the present invention (the claim).
Figure 5:
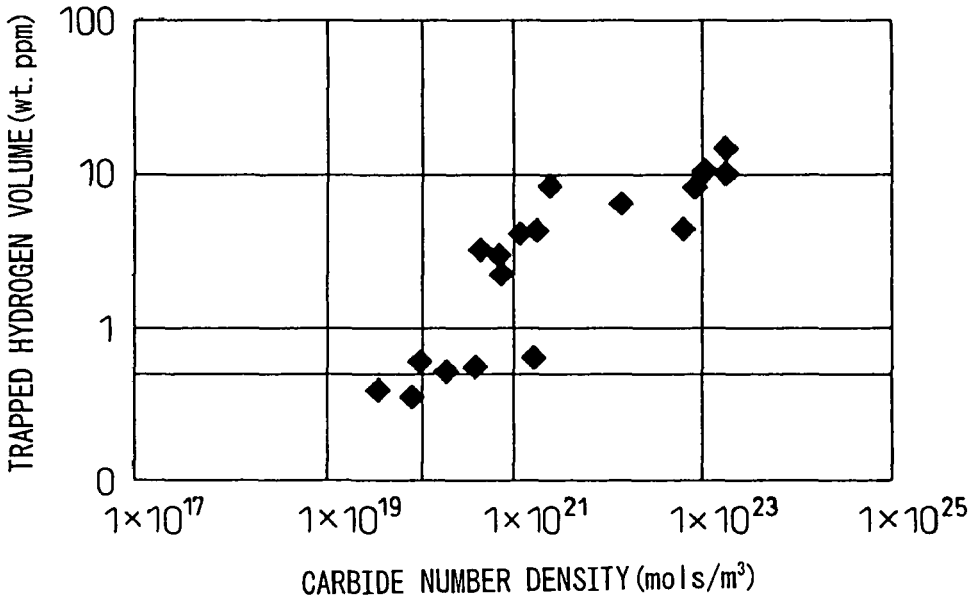
FIG. 5 is a graph showing the relationship between number density and hydrogen trap concentration for carbides satisfying the present invention (the claim).
Figure 6:
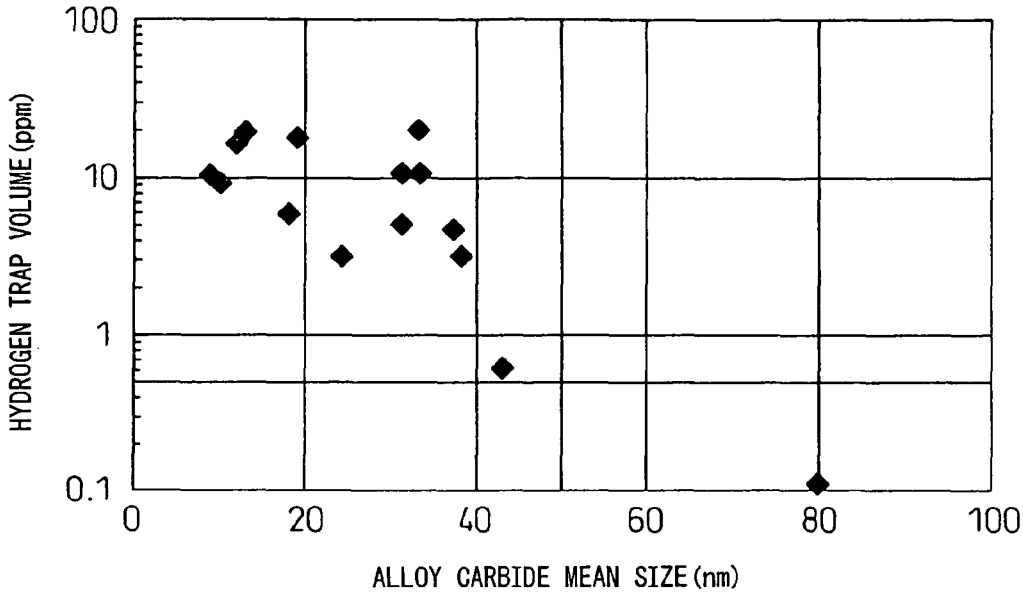
FIG. 6 is a graph showing the relationship between mean size and hydrogen trap concentration of carbides comprising at least 30 atomic percent V and at least 8 atomic percent W, and having an aspect ratio of 3-20 and an FCC structure.
Figure 7:
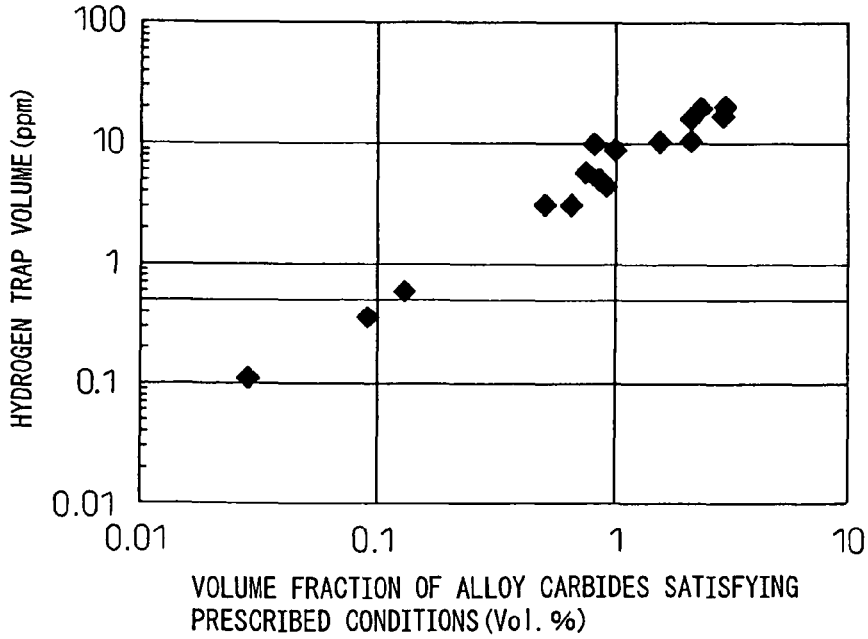
FIG. 7 is a graph showing the relationship between volume ratio and hydrogen trap concentration for carbides satisfying the present invention (the claim).
Figure 8:
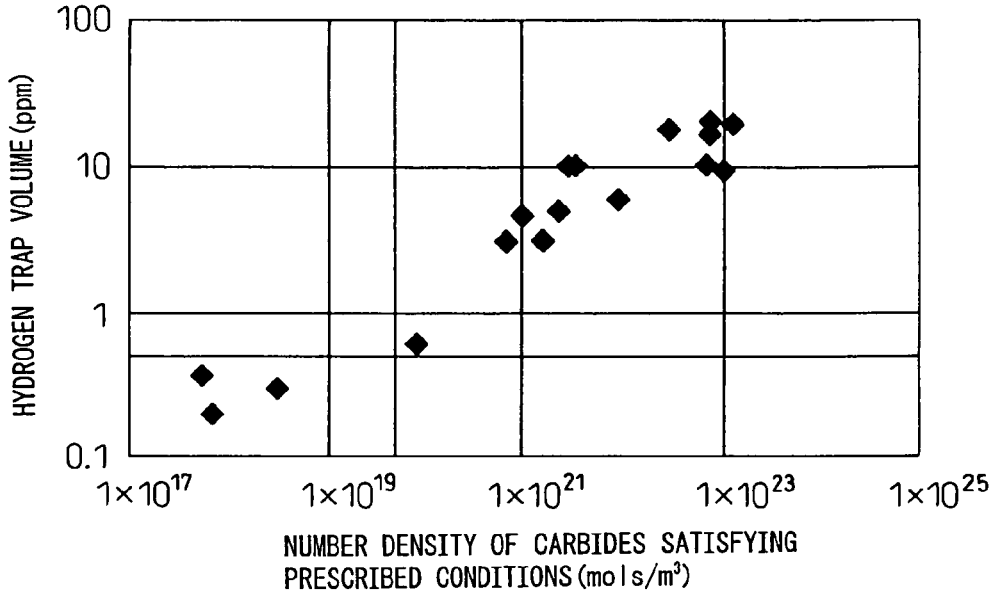
FIG. 8 is a graph showing the relationship between number density and hydrogen trap concentration for carbides satisfying the present invention (the claim).

The composition of high-strength steel according to the invention which permits occlusion of hydrogen will now be explained. The delayed fracture resistance can be improved if the steel:

1) comprises at least 0.1 vol % of a carbide, oxide, nitride or a mixed compound thereof in a sheet form with a length of no greater than 50 nm and a length to thickness ratio (aspect ratio) of 3-20 and having an FCC (face-centered cubic) structure, the compound comprising at least 30 atomic percent V and at least 10 atomic percent Mo among the metal components of the high-strength steel (see FIG. 4), 2) comprises at a number density of at least $1\times10^{20}/m^3$ a carbide, oxide, nitride or a mixed compound thereof in a sheet form with a length of 4-50 nm and a length to thickness aspect ratio of 3-20, the compound comprising at least 30 atomic percent V and at least 10 atomic percent Mo among the metal components of the high-strength steel (see FIG. 5), 3) comprises at least 0.1 vol % of a carbide, oxide, nitride or a mixed compound thereof in a sheet form with a length of no greater than 50 nm and a length to thickness ratio (aspect ratio) of 3-20 and having an FCC (face-centered cubic) structure, the compound comprising at least 30 atomic percent V and at least 8 atomic percent W among the metal components (see FIG. 7), 4) comprises at a number density of at least $5\times10^{19}/m^3$ a carbide, oxide, nitride or a mixed compound thereof in a sheet form with a length of 4-50 nm and a length to thickness ratio (aspect ratio) of 3-20, the compound comprising at least 30 atomic percent V and at least 8 atomic percent W among the metal components (see FIG. 8).

Measurement of the aspect ratio of the compound will now be explained.

An FCC (face-centered cubic) compound comprising at least 30 atomic percent V grows in a roughly quadrilateral laminar form in the [001] and [010] directions on the (100) plane of iron ferrite. Since this orientation relationship is equivalent for growth on the (010) plane and (001) plane, it is possible to observe the length and thickness of these FCC compounds growing on {100} planes which are parallel to the electron beam direction (observation direction), if TEM (transmission electron microscope) thin-foil observation is performed from the <100> directions of the matrix.

(Steel Material Components)

The reason for limiting the steel components according to the invention will now be explained. The amounts of the steel components are all expressed as weight percentages.

C is an essential element for guaranteeing steel material strength, and the required strength cannot be obtained with a content of less than 0.10%, while a content exceeding 1.00% impairs the toughness and the delayed fracture resistance; the range is therefore limited to 0.10-1.00%.

Si increases the strength by a solid solution hardening effect, but at less than 0.05% the effect is not exhibited, while at greater than 2.0% no effect commensurate with further addition can be expected; the range is therefore limited to 0.05-2.0%.

Mn is an element which is not only necessary for deoxidation and desulfurization but is also effective for increasing the hardenability to obtain a martensite composition, but this effect is not achieved at less than 0.2% while a content of greater than 2.0% causes segregation at the grain boundary during heating to an austenite zone temperature, thereby embrittling the grain boundary and impairing the delayed fracture resistance; the range is therefore limited to 0.2-2.0%.

Mo has an effect of forming fine precipitates to inhibit softening during tempering. It also dissolves in the laminar FCC compound and serves to stabilize it. However, the effect is saturated at 3.0%, and addition in a greater amount impairs the workability due to increased deformation resistance; the range is therefore limited to 0.05-3.0%.

V is an element which is effective for precipitation of fine laminar FCC compound in the steel. However, the effect is minimal unless the content is at least 0.1%, while the effect is saturated at greater than 1.5%. Also, addition at greater than 1.5% impairs the workability due to increased deformation resistance, and therefore the range is limited to 0.1-1.5%.

Ratio of Mo and V: Mo/V is a parameter which is important for controlling the chemical composition of the FCC carbides and increasing the hydrogen trap concentration. A Mo/V ratio of less than 0.5 will reduce the hydrogen trap concentration, while a ratio of greater than 5 will promote precipitation of coarse carbides such as $M_2C$ and $M_6C$; thus, the range is limited to 0.5-5.

W is has the effect of forming fine precipitates to inhibit softening during tempering. It also dissolves in the laminar FCC compound and serves to stabilize it. However, the effect is saturated at 3.0%, and addition in a greater amount impairs the workability due to increased deformation resistance; the range is therefore limited to 0.05-3.5%.

Figure 9:
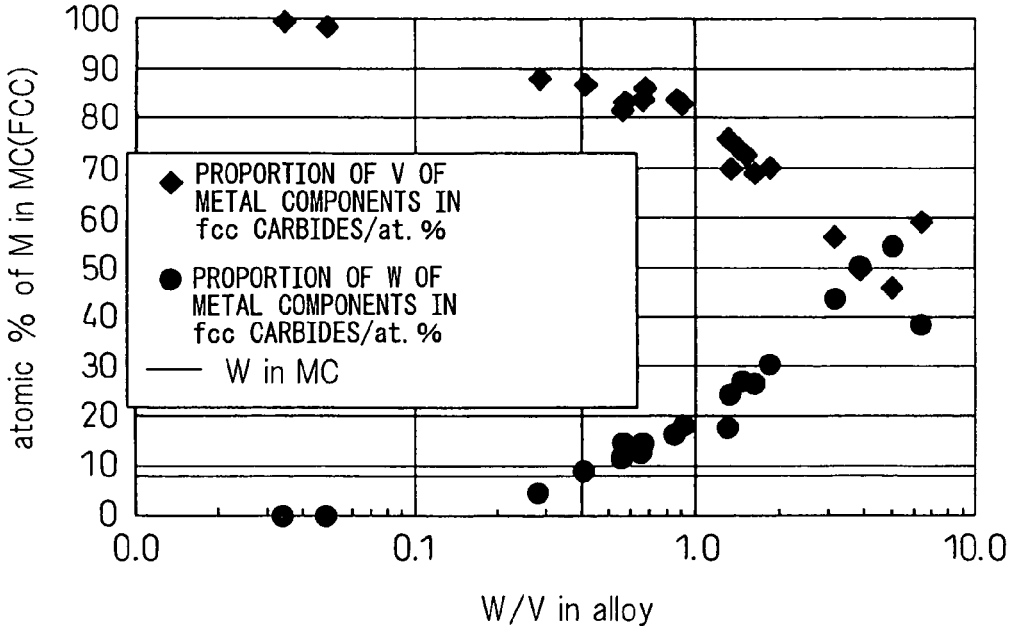
FIG. 9 is a graph showing the relationship between W/V ratio (wt % ratio) in a steel material and the W and V atomic percent concentrations for metal elements of an FCC alloy carbide.

The ratio of W and V (W/V) is a parameter which is important for controlling the chemical composition of the FCC carbides and increasing the hydrogen trap concentration, as shown in FIG. 9. A ratio of less than 0.3 will reduce the hydrogen trap concentration, while a ratio of greater than 7 will promote precipitation of carbides without an FCC structure or coarse carbides, such as $M_2C$; the range is therefore limited to 0.3-7.0.

These are the basic components of the steel material of the invention, but the aforementioned steel according to the invention may also contain one or more from among Cr: 0.05-3.0%, Ni: 0.05-3.0% and Cu: 0.05-2.0%, as a first group, and one or more from among Al: 0.005-0.1%, Ti: 0.005-0.3%, Nb: 0.005-0.3%, B: 0.0003-0.05% and N: 0.001-0.05%, as a second group. The reasons for addition of each of these components will now be explained.

Cr is an element which is effective for improving the hardenability and increasing the softening resistance during tempering treatment, but a content of less than 0.05% will not sufficiently exhibit the effect, while a content of greater than 3.0% will tend to impair the toughness and cold workability; the range is therefore limited to 0.05-3.0%.

Ni is added to improve the ductility which deteriorates with higher strength, while also improving the hardenability during heat treatment to increase the tensile strength, but the effect will be minimal with a content of less than 0.05% while no commensurate effect will be exhibited with addition at greater than 3.0%; the range is therefore limited to 0.05-3.0%.

Cu is an element which is effective for increasing the tempered softening resistance, but at less than 0.05% no effect will be exhibited and at greater than 2.0% the hot workability will be impaired; the range is therefore limited to 0.05-2.0%.

Al forms AlN during deoxidation and heat treatment and produces an effect of preventing coarsening of austenite grains while fixing N, but these effects will not be exhibited if the content is less than 0.005%, while the effect becomes saturated at above 0.1%; the range is therefore limited to 0.005-0.1%.

Ti forms TiN during deoxidation and heat treatment and produces an effect of preventing coarsening of austenite grains while fixing N, but these effects will not be exhibited if the content is less than 0.005%, while the effect becomes saturated at above 0.3%; the range is therefore limited to 0.005-0.3%.

Nb is an element which is effective for rendering fine austenite grains by production of nitrides in the same manner as Ti, but at less than 0.005% the effect will be insufficient, while at greater than 0.3% the effect will be saturated; the range is therefore limited to 0.005-0.3%.

B has the effect of inhibiting cracking at the prior austenite grain boundary and improving the delayed fracture resistance. In addition, B segregates at the austenite grain boundary and thus significantly increases the hardenability, but at less than 0.0003% the effect is not exhibited, and at greater than 0.05% the effect becomes saturated; the range is therefore limited to 0.0003-0.05%.

N bonds with Al, V, Nb and Ti to form nitrides, and has the effect of rendering fine austenite grains and increasing the yield strength. The effect is minimal at less than 0.001% while the effect becomes saturated at greater than 0.05%, and therefore the range is limited to 0.001-0.05%. The range is more preferably 0.005-0.01%.

(Production Process)

According to the invention, it is important to precipitate fine compounds in the ferrite matrix. When carrying out tempering treatment, tempering at 500° C. or above and isothermal transformation at 500° C. or above in the perlite transformation treatment are important, while no particular restrictions are necessary for the other production conditions. This is because if the tempering or isothermal transformation treatment is carried out at below 500° C., it will not be possible to adequately obtain a fine precipitates with an FCC (face-centered cubic) structure to serve as hydrogen trap sites. A more preferred condition is 550° C. or above. While it is not particularly necessary to set an upper limit for the heat treatment temperature, it is preferably below 700° C. because at 700° C. and higher the precipitates will be coarse and the effect of the trap sites will be reduced.

EXAMPLES

Example 1

Test materials having the chemical compositions shown in Table 1 were heat treated under different conditions for transformation into martensite, tempered martensite, bainite, tempered bainite and perlite structures, and then the materials were heated to various temperatures. These test materials were used for evaluation of the mechanical properties, microstructure and delayed fracture properties, yielding the results shown in Table 2. Hydrogen charge was carried out by dipping in 1000 cc of a 20 wt % aqueous $NH_4SCN$ solution at 50° C. for 20 hours or longer, assuming hydrogen absorption by corrosion. The material was then held at room temperature for 100 hours for adequate release of diffusible hydrogen, and the remaining hydrogen concentration was evaluated as the trap hydrogen concentration.

TABLE 1

| | | C | Si | Mn | V | Mo | P | S | Cr | Ni | Cu | Al | Ti | Nb | B | wt % N |
|---|---|---|---|---|---|---|---|---|---|---|---|---|---|---|---|---|
| 1 | Invention | 0.12 | 0.08 | 0.21 | 0.21 | 0.11 | 0.009 | 0.012 | 0.80 | — | — | 0.028 | — | — | — | 0.003 |
| 2 | | 0.60 | 1.98 | 0.80 | 0.3 | 0.10 | 0.009 | 0.012 | — | — | — | 0.035 | 0.025 | — | 0.0020 | 0.005 |
| 3 | | 0.55 | 1.50 | 0.55 | 0.25 | 0.23 | 0.012 | 0.011 | — | — | — | 0.033 | — | — | — | 0.004 |
| 4 | | 0.82 | 1.50 | 0.80 | 0.51 | 0.34 | 0.013 | 0.009 | — | — | — | 0.038 | — | — | — | 0.006 |
| 5 | | 0.80 | 0.80 | 1.59 | 0.30 | 0.56 | 0.006 | 0.009 | — | — | 0.35 | 0.066 | — | — | — | 0.005 |
| 6 | | 0.90 | 0.33 | 0.25 | 0.40 | 1.56 | 0.009 | 0.006 | — | — | — | 0.087 | — | — | — | 0.006 |
| 7 | | 0.75 | 0.89 | 0.50 | 0.36 | 0.54 | 0.013 | 0.009 | — | — | — | 0.032 | — | — | — | 0.007 |
| 8 | | 0.59 | 1.25 | 0.82 | 0.34 | 0.23 | 0.010 | 0.006 | — | — | — | 0.045 | 0.150 | — | 0.0024 | 0.010 |
| 9 | | 0.70 | 0.80 | 0.75 | 0.25 | 0.80 | 0.013 | 0.009 | — | 0.72 | — | 0.055 | — | — | — | 0.008 |
| 10 | | 0.55 | 0.05 | 0.51 | 0.35 | 0.58 | 0.010 | 0.012 | 1.20 | — | — | 0.030 | — | — | — | 0.006 |
| 11 | | 0.41 | 1.65 | 0.8 | 0.90 | 1.20 | 0.007 | 0.008 | 1.60 | — | 0.20 | — | 0.230 | 0.01 | 0.0031 | 0.008 |
| 12 | | 0.62 | 1.64 | 0.8 | 0.89 | 1.21 | 0.007 | 0.008 | 1.59 | — | 0.20 | 0.027 | 0.220 | 0.01 | 0.0030 | 0.007 |
| 13 | | 0.61 | 0.08 | 0.21 | 0.45 | 1.50 | 0.009 | 0.012 | 0.80 | 2.90 | — | 0.028 | — | — | — | 0.003 |
| 14 | | 0.55 | 0.05 | 0.51 | 1.02 | 0.58 | 0.010 | 0.012 | 1.20 | — | — | 0.030 | — | — | — | 0.006 |
| 15 | | 0.95 | 0.05 | 0.50 | 1.50 | 0.80 | 0.010 | 0.012 | 1.20 | — | — | 0.030 | — | — | — | 0.007 |
| 16 | | 0.88 | 0.25 | 0.96 | 0.67 | 2.56 | 0.010 | 0.006 | — | — | — | 0.036 | — | 0.05 | — | 0.009 |
| 17 | Comparison | 0.04 | 0.21 | 0.79 | 0.35 | 0.20 | 0.009 | 0.005 | 1.21 | — | — | 0.034 | — | — | — | 0.008 |
| 18 | | 0.41 | 0.21 | 0.79 | 0.23 | 0.20 | 0.009 | 0.005 | — | — | — | 0.030 | — | — | — | 0.007 |
| 19 | | 0.84 | 0.21 | 0.79 | 0.03 | 0.20 | 0.009 | 0.005 | 1.21 | 1.01 | — | 0.034 | — | — | — | 0.008 |
| 20 | | 0.60 | 0.25 | 0.80 | 0.02 | — | 0.011 | 0.009 | — | — | — | 0.020 | 0.030 | — | 0.0014 | 0.006 |
| 21 | | 0.59 | 0.36 | 0.89 | — | 1.02 | 0.009 | 0.006 | 0.80 | 0.10 | — | 0.031 | — | — | — | 0.005 |
| 22 | | 0.55 | 3.10 | 0.79 | 0.30 | 0.20 | 0.009 | 0.005 | 1.21 | 2.00 | — | 0.034 | — | — | — | 0.008 |

TABLE 1-continued

| | C | Si | Mn | V | Mo | P | S | Cr | Ni | Cu | Al | Ti | Nb | B | wt % N |
|---|---|---|---|---|---|---|---|---|---|---|---|---|---|---|---|
| 23 | 0.60 | 0.05 | 0.25 | 0.33 | 0.80 | 0.010 | 0.011 | 1.20 | — | — | 0.030 | 1.010 | — | — | 0.010 |
| 24 | 0.64 | 0.98 | 0.51 | 0.41 | 3.65 | 0.009 | 0.008 | 1.99 | — | — | 0.025 | — | — | — | 0.010 |
| 25 | 0.82 | 1.50 | 0.80 | 0.40 | — | 0.013 | 0.009 | — | — | — | 0.038 | — | 1.12 | — | 0.006 |
| 26 | 1.20 | 1.25 | 0.82 | 0.41 | — | 0.010 | 0.006 | — | — | — | 0.045 | 0.030 | — | 0.0024 | 0.010 |
| 27 | 0.65 | 1.68 | 2.40 | 0.29 | — | 0.011 | 0.009 | — | — | — | 0.031 | — | — | — | 0.009 |

TABLE 2

| | | Mo/V | Lattice structure of precipitate | Precipitate morphology | Precipitate mean size nm | Precipitate mean aspect ratio | Precipitate volume ratio/% | Precipitate number density/$m^3$ | Hydrogen trap energy/kJ/mol | Tensile strength/MPa | Threshold hydrogen concentration/ppm | Trap hydrogen concentration/ppm |
|---|---|---|---|---|---|---|---|---|---|---|---|---|
| 1 | Invention | 0.52 | FCC | laminar | 44.00 | 5.10 | 0.17 | $1.019 \times 10^{20}$ | 27.80 | 1210 | 2.10 | 0.60 |
| 2 | | 1.25 | FCC | laminar | 34.00 | 6.20 | 0.12 | $1.931 \times 10^{20}$ | 35.60 | 1568 | 0.81 | 0.51 |
| 3 | | 0.92 | FCC | laminar | 25.00 | 4.50 | 0.14 | $4.014 \times 10^{20}$ | 33.60 | 1519 | 0.88 | 0.55 |
| 4 | | 0.67 | FCC | laminar | 20.00 | 6.80 | 1.67 | $1.418 \times 10^{22}$ | 30.90 | 1784 | 6.50 | 6.30 |
| 5 | | 1.87 | FCC | laminar | 18.00 | 7.10 | 0.14 | $1.675 \times 10^{21}$ | 28.10 | 1764 | 0.98 | 0.63 |
| 6 | | 3.90 | FCC | laminar | 32.00 | 8.20 | 0.71 | $1.771 \times 10^{21}$ | 29.20 | 1862 | 4.48 | 4.20 |
| 7 | | 1.50 | FCC | laminar | 45.00 | 5.50 | 0.74 | $4.457 \times 10^{20}$ | 28.50 | 1715 | 3.40 | 3.20 |
| 8 | | 0.68 | FCC | laminar | 40.00 | 5.90 | 0.77 | $7.065 \times 10^{20}$ | 40.60 | 1558 | 3.30 | 2.90 |
| 9 | | 3.20 | FCC | laminar | 32.00 | 6.10 | 0.40 | $7.492 \times 10^{20}$ | 29.10 | 1666 | 2.55 | 2.20 |
| 10 | | 1.66 | FCC | laminar | 36.00 | 6.20 | 0.90 | $1.198 \times 10^{21}$ | 33.10 | 1519 | 4.30 | 4.00 |
| 11 | | 1.33 | FCC | laminar | 11.00 | 10.20 | 2.32 | $1.779 \times 10^{23}$ | 46.30 | 1382 | 10.70 | 9.80 |
| 12 | | 1.36 | FCC | laminar | 14.00 | 12.00 | 1.93 | $8.458 \times 10^{22}$ | 45.60 | 1588 | 8.50 | 8.20 |
| 13 | | 3.33 | FCC | laminar | 9.00 | 6.00 | 0.78 | $6.400 \times 10^{22}$ | 29.60 | 1578 | 4.72 | 4.32 |
| 14 | | 0.57 | FCC | laminar | 12.00 | 6.70 | 2.75 | $1.065 \times 10^{23}$ | 33.20 | 1519 | 10.55 | 10.20 |
| 15 | | 0.53 | FCC | laminar | 11.00 | 5.90 | 4.07 | $1.802 \times 10^{23}$ | 33.60 | 1840 | 14.88 | 14.60 |
| 16 | | 3.82 | FCC | laminar | 34.00 | 6.90 | 1.41 | $2.478 \times 10^{21}$ | 28.60 | 1820 | 8.80 | 8.30 |
| 17 | Comparison | 0.57 | FCC | laminar | 27.00 | 5.40 | 0.03 | $8.230 \times 10^{19}$ | 31.20 | 1019 | 0.55 | 0.35 |
| 18 | | 0.87 | FCC | laminar | 120.00 | 2.80 | 0.08 | $1.242 \times 10^{18}$ | 32.60 | 1382 | 0.45 | 0.30 |
| 19 | | 6.67 | HCP | acicular | 150.00 | 16.00 | 0.03 | $1.219 \times 10^{18}$ | 22.00 | 1803 | 0.26 | 0.20 |
| 20 | | 0.00 | FCC | laminar | 12.00 | 7.20 | 0.07 | $2.750 \times 10^{21}$ | 31.00 | 1568 | 0.30 | 0.22 |
| 21 | | — | HCP | acicular | 135.00 | 14.00 | 0.01 | $5.690 \times 10^{17}$ | 21.50 | 1558 | 0.30 | 0.19 |
| 22 | | 0.67 | FCC | laminar | 45.00 | 6.80 | 0.05 | $3.731 \times 10^{19}$ | 33.20 | 1519 | 0.51 | 0.39 |
| 23 | | 2.42 | FCC | laminar | 34.00 | 7.20 | 0.05 | $8.636 \times 10^{19}$ | 45.60 | 1568 | 0.49 | 0.35 |
| 24 | | 8.90 | FCC | spheroid | 87.00 | 1.40 | 0.04 | $7.570 \times 10^{17}$ | 33.80 | 1607 | 0.43 | 0.33 |
| 25 | | 0.00 | FCC | laminar | 23.00 | 6.00 | 0.10 | $4.734 \times 10^{20}$ | 31.50 | 1784 | 0.38 | 0.32 |
| 26 | | 0.00 | FCC | laminar | 17.00 | 7.10 | 0.12 | $1.691 \times 10^{21}$ | 43.60 | 1850 | 0.44 | 0.39 |
| 27 | | 0.00 | FCC | laminar | 12.00 | 5.80 | 0.08 | $2.551 \times 10^{21}$ | 28.20 | 1617 | 0.48 | 0.38 |

Tables 1 and 2 show examples corresponding to the claim, where Test Nos. 1-16 are invention examples and the others are comparative examples. As seen in these tables, all of the invention examples exhibited hydrogen trapping of 0.5 ppm or greater by weight. In contrast, the comparative example No. 17 was an example with a low hydrogen trap concentration, where the 0.1 vol % or greater carbide content target according to the invention could not be achieved because of a low C content. Also, the comparative example No. 18 is an example with a low hydrogen trap concentration, with an excessive carbide coarseness. The comparative examples Nos. 19 and 21 are examples with low hydrogen trap concentrations, where the Mo/V ratio of the steel was too high and $M_2C$ carbides consisting mainly of Mo were precipitated. The comparative examples Nos. 20, 25, 26 and 27 were examples with low hydrogen trap concentrations, where the Mo/V ratio of the steel was too low. The comparative examples Nos. 22 and 23 are examples with low hydrogen trap concentrations, where the heat treatment conditions were unsuitable and a carbide content of 0.1 vol % or greater could not be obtained. The comparative example No. 24 is an example with a low hydrogen trap concentration, where the Mo/V ratio of the steel was too high and $M_6C$ carbides consisting mainly of Mo were precipitated.

Example 2

Test materials having the chemical compositions shown in Table 3 were heat treated under different conditions for transformation into martensite, tempered martensite, bainite, tempered bainite and perlite structures, and then the materials were heated to various temperatures. These test materials were used for evaluation of the mechanical properties, microstructure and delayed fracture properties, yielding the results shown in Table 4. Hydrogen charge was carried out by dipping in 1000 cc of a 20 wt % aqueous $NH_4SCN$ solution at 50° C. for 20 hours or longer, assuming hydrogen absorption by corrosion. The material was then held at room temperature for 100 hours for adequate release of diffusible hydrogen, and the remaining hydrogen concentration was evaluated as the trap hydrogen concentration.

TABLE 3

| | | C | Si | Mn | V | W | P | S | Cr | Ni | Cu | Mo | Al | Ti | Nb | B | N |
|---|---|---|---|---|---|---|---|---|---|---|---|---|---|---|---|---|---|
| 28 | Invention | 0.60 | 0.08 | 0.79 | 0.11 | 0.10 | 0.009 | 0.012 | 0.00 | — | — | — | 0.035 | 0.025 | — | 0.0020 | 0.005 |
| 29 | | 0.41 | 0.05 | 0.21 | 0.90 | 1.20 | 0.007 | 0.008 | 1.60 | — | 0.20 | — | — | 0.230 | 0.01 | 0.0031 | 0.008 |
| 30 | | 0.55 | 0.75 | 0.54 | 0.25 | 0.23 | 0.012 | 0.011 | 0.00 | — | — | — | — | — | — | — | 0.004 |
| 31 | | 0.80 | 0.08 | 1.56 | 0.30 | 0.56 | 0.006 | 0.009 | 0.00 | — | 0.35 | 1.20 | 0.035 | — | — | — | 0.005 |
| 32 | | 0.75 | 0.85 | 0.49 | 0.36 | 0.54 | 0.013 | 0.009 | 0.00 | — | — | — | 0.032 | — | — | — | 0.007 |
| 33 | | 0.59 | 1.35 | 0.83 | 0.34 | 0.23 | 0.010 | 0.006 | 0.00 | — | — | 0.30 | 0.045 | 0.150 | — | 0.0024 | 0.010 |
| 34 | | 0.90 | 0.31 | 0.24 | 0.40 | 1.56 | 0.009 | 0.006 | 0.00 | 0.10 | — | — | 0.087 | — | — | — | 0.006 |
| 35 | | 0.55 | 1.65 | 0.50 | 0.35 | 0.58 | 0.010 | 0.012 | 0.00 | — | — | — | 0.030 | — | — | — | 0.006 |
| 36 | | 0.82 | 0.36 | 0.81 | 0.51 | 0.34 | 0.013 | 0.009 | 0.00 | — | — | 0.51 | 0.038 | — | — | — | 0.006 |
| 37 | | 0.62 | 1.02 | 0.31 | 0.89 | 1.21 | 0.007 | 0.008 | 1.59 | — | 0.20 | — | 0.027 | 0.220 | 0.01 | 0.0030 | 0.007 |
| 38 | | 0.95 | 0.09 | 0.52 | 1.40 | 0.58 | 0.010 | 0.012 | 1.20 | 0.20 | — | — | 0.030 | — | — | — | 0.007 |
| 39 | | 0.70 | 0.85 | 0.76 | 0.25 | 0.80 | 0.013 | 0.009 | 0.00 | 0.72 | — | 0.50 | 0.055 | — | — | — | 0.008 |
| 40 | | 0.55 | 0.05 | 0.50 | 1.02 | 0.58 | 0.010 | 0.012 | 1.20 | — | — | — | 0.030 | — | — | — | 0.006 |
| 41 | | 0.88 | 0.25 | 0.98 | 0.67 | 3.41 | 0.010 | 0.006 | 0.00 | — | — | — | 0.036 | — | 0.05 | — | 0.009 |
| 42 | Comparison | 0.04 | 0.21 | 0.79 | 0.35 | 0.20 | 0.009 | 0.005 | 1.21 | — | — | — | 0.034 | — | — | — | 0.008 |
| 43 | | 0.41 | 0.21 | 0.79 | 0.23 | 0.20 | 0.009 | 0.009 | 0.00 | — | — | — | 0.030 | — | — | — | 0.007 |
| 44 | | 0.12 | 1.91 | 0.22 | 0.21 | 0.06 | 0.009 | 0.012 | 0.80 | — | — | — | 0.028 | — | — | — | 0.003 |
| 45 | | 0.84 | 0.21 | 0.79 | 0.03 | 0.20 | 0.009 | 0.005 | 1.19 | 1.01 | — | — | 0.034 | — | — | — | 0.008 |
| 46 | | 0.84 | 0.20 | 0.8 | 0.03 | 0.30 | 0.008 | 0.006 | 1.21 | 1.00 | — | — | 0.046 | — | — | — | 0.004 |
| 47 | | 0.83 | 0.21 | 0.8 | 0.03 | 0.50 | 0.009 | 0.007 | 1.20 | 0.99 | — | — | 0.030 | — | — | — | 0.008 |
| 48 | | 0.84 | 0.19 | 0.81 | 0.04 | 1.00 | 0.010 | 0.005 | 0.00 | — | — | — | 0.029 | — | — | — | 0.005 |
| 49 | | 0.64 | 0.21 | 0.81 | 0.03 | 1.01 | 0.008 | 0.007 | 0.00 | — | 0.20 | — | 0.041 | — | — | — | 0.008 |
| 50 | | 0.44 | 0.21 | 0.79 | 0.03 | 1.00 | 0.011 | 0.008 | 0.00 | — | — | _ | 0.046 | — | — | — | 0.007 |
| 51 | | 0.10 | 0.20 | 0.79 | 0.04 | 1.00 | 0.009 | 0.005 | 0.00 | — | — | — | 0.034 | — | — | — | 0.004 |
| 52 | | 0.60 | 0.25 | 0.80 | 0.02 | 0.00 | 0.011 | 0.009 | 0.80 | 0.10 | — | — | 0.020 | 0.030 | — | 0.0014 | 0.006 |
| 53 | | 0.59 | 0.36 | 0.89 | 0.00 | 1.02 | 0.009 | 0.006 | 0.80 | 0.10 | — | 0.10 | 0.031 | — | — | — | 0.005 |
| 54 | | 0.55 | 3.10 | 0.79 | 0.30 | 0.20 | 0.009 | 0.005 | 1.21 | 2.00 | — | 0.14 | 0.034 | — | — | — | 0.008 |
| 55 | | 0.60 | 0.05 | 0.25 | 0.33 | 0.80 | 0.010 | 0.011 | 1.20 | — | — | — | 0.030 | 1.010 | — | — | 0.010 |
| 56 | | 0.64 | 0.98 | 0.51 | 0.41 | 3.65 | 0.009 | 0.008 | 1.99 | — | 0.10 | — | 0.025 | — | — | — | 0.010 |
| 57 | | 0.82 | 1.50 | 0.80 | 0.40 | 0.15 | 0.013 | 0.009 | 0.00 | — | — | 0.19 | 0.038 | — | 1.12 | — | 0.006 |
| 58 | | 1.20 | 1.25 | 0.82 | 0.41 | 0.02 | 0.010 | 0.006 | 0.00 | — | — | — | 0.045 | 0.030 | — | 0.0024 | 0.010 |
| 59 | | 0.65 | 1.68 | 2.40 | 0.29 | 0.01 | 0.011 | 0.009 | 0.00 | — | — | 0.10 | 0.031 | — | — | — | 0.009 |

TABLE 4

| | | W/V | Lattice structure of precipitate | Precipitate morphology | Precipitate mean size/nm | Precipitate mean aspect ratio | V proportion of metal components in fcc precipitate/at. % | W proportion of metal components in fcc precipitate/at. % | Volume ratio of fcc laminar precipitate/% | precipitate number density/m$^3$ | Hydrogen trap energy/kJ/mol | Tensile strength/MPa | Threshold hydrogen concentration/ppm | Trap hydrogen concentration/ppm |
|---|---|---|---|---|---|---|---|---|---|---|---|---|---|---|
| 28 | In- | 0.90 | fcc | laminar | 43.00 | 5.10 | 82.98 | 17.02 | 0.13 | 8.48E+19 | 29.3 | 1380 | 1.23 | 0.6 |
| 29 | ven- | 1.33 | fcc | laminar | 33.00 | 6.20 | 75.73 | 17.43 | 2.07 | 3.58E+21 | 29.5 | 1479 | 11.20 | 10.3 |
| 30 | tion | 0.92 | fcc | laminar | 24.00 | 4.50 | 85.43 | 17.57 | 0.51 | 1.66E+21 | 29.5 | 1404 | 3.60 | 3.1 |
| 31 | | 1.86 | fcc | laminar | 18.00 | 7.10 | 69.83 | 30.17 | 0.76 | 9.20E+21 | 32.7 | 1542 | 6.40 | 5.9 |
| 32 | | 1.50 | fcc | laminar | 31.00 | 8.20 | 73.02 | 26.98 | 0.87 | 2.38E+21 | 31.9 | 1556 | 5.60 | 5.0 |
| 33 | | 0.67 | fcc | laminar | 38.00 | 5.90 | 86.14 | 13.86 | 0.66 | 7.11E+20 | 28.5 | 1467 | 4.03 | 3.1 |
| 34 | | 3.89 | fcc | laminar | 31.00 | 6.10 | 49.81 | 50.19 | 1.53 | 3.13E+21 | 37.7 | 1674 | 11.88 | 10.5 |
| 35 | | 1.65 | fcc | laminar | 37.00 | 6.20 | 69.08 | 26.50 | 0.89 | 1.09E+21 | 31.8 | 1477 | 5.90 | 4.6 |
| 36 | | 0.67 | fcc | laminar | 10.00 | 10.20 | 85.78 | 14.22 | 1.00 | 1.02E+23 | 28.6 | 1578 | 11.01 | 9.1 |
| 37 | | 1.36 | fcc | laminar | 13.00 | 12.00 | 69.76 | 24.19 | 2.29 | 1.25E+23 | 31.2 | 1652 | 22.15 | 19.3 |
| 38 | | 0.41 | fcc | laminar | 19.00 | 6.80 | 86.44 | 8.78 | 2.88 | 2.85E+22 | 27.2 | 1804 | 18.50 | 17.6 |
| 39 | | 3.19 | fcc | laminar | 9.00 | 6.00 | 56.23 | 43.77 | 0.82 | 6.78E+22 | 36.1 | 1528 | 11.00 | 10.0 |
| 40 | | 0.57 | fcc | laminar | 12.00 | 5.90 | 82.31 | 11.88 | 2.11 | 7.21E+22 | 28.1 | 1524 | 18.20 | 16.6 |
| 41 | | 5.08 | fcc | laminar | 33.00 | 6.90 | 45.74 | 54.26 | 2.91 | 7.21E+22 | 28.1 | 1778 | 20.73 | 19.8 |
| 42 | Com- | 0.57 | fcc | laminar | 45.00 | 5.40 | 83.00 | 14.30 | 0.09 | 5.37E+17 | 25.4 | 1140 | 0.96 | 0.4 |
| 43 | par- | 0.87 | fcc | spheroid | 120.00 | 2.80 | 83.58 | 16.42 | 0.47 | 7.60E+18 | 29.2 | 1290 | 0.79 | 0.1 |
| 44 | ison | 0.28 | fcc | laminar | 44.00 | 5.50 | 88.06 | 4.57 | 0.38 | 2.48E+20 | 26.2 | 1232 | 1.00 | 0.5 |
| 45 | | 6.45 | fcc | laminar | 80.00 | 16.00 | 58.88 | 38.28 | 0.03 | 8.95E+18 | 34.8 | 1587 | 0.36 | 0.1 |
| 46 | | 9.68 | hcp | needle | 110.00 | 11.00 | — | — | 0.06 | 5.45E+19 | 23.0 | 1593 | 0.45 | 0.2 |
| 47 | | 16.13 | hcp | needle | 215.00 | 12.00 | — | — | 0.14 | 2.10E+19 | 17.7 | 1597 | 0.62 | 0.4 |
| 48 | | 24.39 | hcp | needle | 181.00 | 9.00 | — | — | 0.46 | 6.24E+19 | 22.0 | 1568 | 0.40 | 0.2 |
| 49 | | 32.58 | hcp | needle | 161.00 | 7.00 | — | — | 0.48 | 5.68E+19 | 22.1 | 1448 | 0.32 | 0.2 |
| 50 | | 32.26 | hcp | needle | 142.00 | 11.00 | — | — | 0.51 | 2.15E+20 | 22.1 | 1328 | 0.35 | 0.2 |
| 51 | | 24.39 | hcp | needle | 111.00 | 12.00 | — | — | 0.54 | 5.67E+20 | 22.2 | 1124 | 0.91 | 0.2 |
| 52 | | 0.00 | — | — | — | — | — | — | 0.00 | — | 25.0 | 1415 | 0.32 | 0.0 |
| 53 | | ∞ | hcp | needle | 135.00 | 14.00 | — | — | 0.00 | — | 24.0 | 1463 | 0.70 | 0.3 |
| 54 | | 0.66 | fcc | laminar | 44.00 | 6.80 | 83.50 | 13.02 | 1.20 | 6.51E+21 | 29.5 | 1586 | 0.60 | 5.4 |
| 55 | | 2.42 | fcc | laminar | 200.00 | 3.10 | 12.30 | 3.30 | 0.35 | 7.10E+17 | 36.1 | 1496 | 0.46 | 0.2 |
| 56 | | 8.88 | hcp | needle | 87.00 | 1.40 | — | — | 0.00 | — | 38.6 | 1756 | 0.09 | 0.0 |
| 57 | | 0.37 | fcc | laminar | 181.00 | 2.80 | 10.00 | 0.00 | 0.62 | 3.05E+18 | 25.0 | 1615 | 0.46 | 0.3 |

TABLE 4-continued

| | W/V | Lattice structure of precipitate | Precipitate morphology | Precipitate mean size/nm | Precipitate mean aspect ratio | V proportion of metal components in fcc precipitate/at. % | W proportion of metal components in fcc precipitate/at. % | Volume ratio of fcc laminar precipitate/% | precipitate number density/$m^3$ | Hydrogen trap energy/kJ/mol | Tensile strength/MPa | Threshold hydrogen concentration/ppm | Trap hydrogen concentration/ppm |
|---|---|---|---|---|---|---|---|---|---|---|---|---|---|
| 58 | 0.05 | fcc | laminar | 17.00 | 7.10 | 98.10 | 0.00 | 0.00 | — | 25.0 | 1825 | 0.09 | 0.0 |
| 59 | 0.03 | — | — | 12.00 | 5.80 | 99.10 | 0.00 | 0.00 | — | 25.0 | 1504 | 0.13 | 0.0 |

Tables 3 and 4 show examples corresponding to the claim, where Test Nos. 28-41 are invention examples and the others are comparative examples. As seen in these tables, all of the invention examples exhibited hydrogen trapping of 0.6 ppm or greater by weight. In contrast, the comparative example No. 42 was an example with a low hydrogen trap concentration, where the 0.1 vol % or greater FCC alloy carbide content target according to the invention could not be achieved because of a low C content.

The comparative example No. 54 is an example in which the Si addition was too high, and therefore the workability and ductility were poor and the delayed fracture property was not improved.

The comparative example No. 55 is an example with a low hydrogen trap concentration because of the predominance of coarse TiC carbide due to excessively high Ti addition.

The comparative example No. 57 is an example with a low hydrogen trap concentration because of the predominance of coarse NbC carbide due to excessively high Nb addition.

The comparative examples Nos. 46, 47, 48, 49, 50, 51, 53 and 56 are examples with low hydrogen trap concentrations, where the W/V ratio of the steel was too high and $M_2C$ carbides consisting mainly of W were precipitated.

The comparative examples Nos. 44, 52, 58 and 59 are examples with low hydrogen trap concentrations, where the W/V ratio of the steel was too low.

The comparative examples Nos. 43 and 45 are examples with low hydrogen trap concentrations where the heat treatment conditions were unsuitable and an FCC alloy carbide content of 0.1 vol % could not be obtained.

INDUSTRIAL APPLICABILITY

As explained above, according to the present invention carbides with suitable structures, sizes, components and number densities are precipitated in martensite, tempered martensite, bainite, tempered bainite and perlite structures to improve the hydrogen trap properties of steel materials, while the diffusible hydrogen concentration which causes hydrogen embrittlement of steel materials is relatively reduced to allow improvement in hydrogen embrittlement resistance even with steel materials having high strength of 1200 MPa or greater.

What is claimed is:

1. A steel material with excellent hydrogen embrittlement resistance, characterized in that the steel material has a composition consisting of, by weight, C: 0.41-0.80%, Si: 0.05-2.0%, Mn: 0.2-2.0%, Mo: 0.05-3.0%, V: 0.21-0.35%, and satisfying the inequality $0.5<Mo/V<5$, and the balance Fe and unavoidable impurities, and the steel material consisting essentially of tempered martensite, bainite or pearlite structure obtained by tempering at more than 500° C., and 0.1-4.07 vol % of an alloy carbide having a number density of at least $1\times10^{20}/m^3$ thereof in a sheet form with said sheet form having a length of no greater than 50 nm and said sheet form having a length to thickness ratio (aspect ratio) of 3-20 and consisting essentially of MC carbide having an FCC (face-centered cubic) structure, the alloy carbide comprising at least 30 atomic percent V and at least 10 atomic percent Mo as constituent metal components, whereby after being dipped in 1000 cc of a 20 wt % aqueous $NH_4SCN$ solution at 50° C. and subsequently held for 100 hours in air at 25° C., hydrogen analysis raising the temperature at a rate of 100° C./hr yields a hydrogen evolution peak in a temperature range of 180° C. to 400° C. and the evolved hydrogen concentration is 0.5 ppm or greater by weight with an activation energy of 25-50 kJ/mol.

* * * * *